US006394270B1

(12) United States Patent
Liu

(10) Patent No.: US 6,394,270 B1
(45) Date of Patent: May 28, 2002

(54) STRUCTURE OF A LIPSTICK CASE

(76) Inventor: Ming Hsiung Liu, PO Box 82-144, Taipei (TW)

( * ) Notice: Subject to any disclaimer, the term of this patent is extended or adjusted under 35 U.S.C. 154(b) by 0 days.

(21) Appl. No.: 09/727,481

(22) Filed: Dec. 4, 2000

(51) Int. Cl.[7] ..... B65D 85/72
(52) U.S. Cl. ..... 206/385; 401/78
(58) Field of Search ..... 206/385, 581; 132/318; 401/68, 69, 75, 78, 88, 98

(56) References Cited

U.S. PATENT DOCUMENTS 2,057,085 A * 10/1936 Danco ..... 206/385
2,159,872 A * 5/1939 Younghusband ..... 401/78
2,336,328 A * 12/1943 Whalen ..... 206/385
4,813,801 A * 3/1989 Cardia ..... 206/385
5,653,338 A * 8/1997 Tani ..... 206/385
6,293,391 B1 * 9/2001 Kim ..... 206/385

* cited by examiner

*Primary Examiner*—Luan K. Bui
(74) *Attorney, Agent, or Firm*—A & J

(57) ABSTRACT

A lipstick case includes a tubular housing, a connecting sleeve fitted within the tubular housing and having an upper end extending out of the tubular housing, a cap engageable with an upper end of the connecting sleeve, a core movably mounted within the connecting sleeve and having a chamber for receiving a lipstick, the core having a downwardly extending member, a supporting bracket disposed within the tubular housing and provided with two vertical members, a hand wheel rotatably arranged between the two vertical members and formed with two gears at two sides thereof, and a toothed rack fixedly mounted on an inner side of the downwardly extending member of the core and meshed with one of the gears of the hand wheel.

2 Claims, 1 Drawing Sheet

STRUCTURE OF A LIPSTICK CASE

BACKGROUND OF THE INVENTION (a) Technical Field of the Invention

This invention is related to an improvement in the structure of a lipstick case and in particular to one which can be easily operated by a single hand.

(b) Description of the Prior Art

Lipstick is the favorite cosmetic of women. Nowadays, the lipstick cases seen on the market generally include an outer casing, a cap and a connecting sleeve connecting the outer casing and the cap. The connecting sleeve has a movable core for receiving a lipstick by means of a screw-type transmission mechanism. Turning the rotation of the outer casing will cause the core and the lipstick to extend out of the casing or retract into the casing. However, when in use, such a kind of lipstick case must be first held by one hand and then turned by another hand in order to control the movement of the lipstick. In addition, when in retraction, the lipstick will rub with the connecting sleeve. Therefore, it is an object of the present invention to obviate and mitigate the above-mentioned drawbacks.

SUMMARY OF THE INVENTION

This invention is related to an improvement in the structure of a lipstick case.

It is the primary object of the present invention to provide an improved lipstick case which can be easily operated with a single hand.

It is another object of the present invention to provide an improved lipstick case which enables a lipstick to move outwardly or inwardly in a steady manner thereby preventing it from rubbing with the connecting sleeve.

According to a preferred embodiment of the present invention, a lipstick case includes a tubular housing, a connecting sleeve fitted within the tubular housing and having an upper end extending out of the tubular housing, a cap engageable with an upper end of the connecting sleeve, a core movably mounted within the connecting sleeve and having a chamber for receiving a lipstick, the core having a downwardly extending member, a supporting bracket disposed within the tubular housing and provided with two vertical members, a hand wheel rotatably arranged between the two vertical members and formed with two gears at two sides thereof, and a toothed rack fixedly mounted on an inner side of the downwardly extending member of the core and meshed with one of the gears of the hand wheel.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
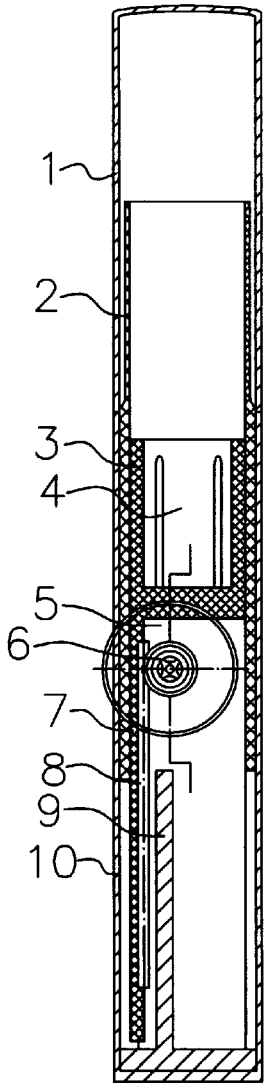
FIG. 1 is a sectional view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
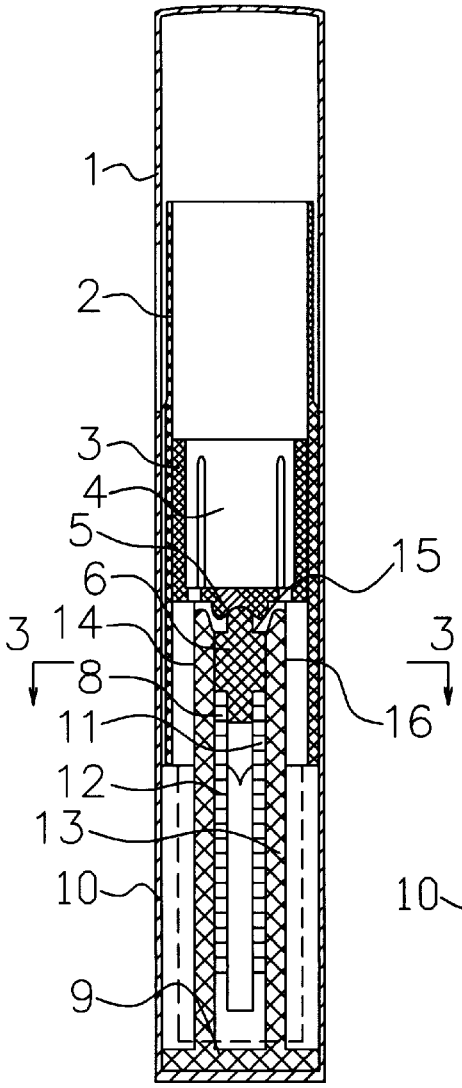
FIG. 2 is a sectional view taken along line A—A of FIG. 1.

With reference to the drawings and in particular to FIGS. 1 and 2 thereof, the lipstick case according to the present invention generally comprises a tubular housing 10, a cap 1 and a connecting sleeve 2. The tubular housing 10 and the cap 1 are preferably made of aluminum and are of an elliptical cross section. The connecting sleeve 2 is provided with a core 3 which is movable within the connecting sleeve 2. The core 3 has a chamber 4 for receiving a lipstick (not shown). The core 3 has a downwardly extending member 7. A supporting bracket 9 is disposed within the tubular housing 10 and provided with two vertical members 12 and 13 having two aligned holes 15 and 16. A hand wheel 5 is arranged between the two vertical members 12 and 13 and has two axial ends rotatably fitted into the two aligned holes 15 and 16 so that the hand wheel 5 may rotate with respect to the two vertical members 12 and 13. The hand wheel 5 is formed with two smaller gears 6 and 14 at two sides thereof. Two toothed racks 8 and 11 are fixedly mounted on the inner side of the downwardly extending member 7 of the core 3 and meshed with the gears 6 and 14 of the hand wheel 5, so that when the hand wheel 5 is rotated, the gears 6 and 14 will move the toothed racks 8 and 11 to go upwardly or downwardly, depending on the rotating direction of the hand wheel 5. As the toothed racks 8 and 11 are fixedly mounted on the downwardly extending member 7 of the core 3, the core 3 together with the lipstick therein will be moved along the connecting sleeve 2.

Figure 3:
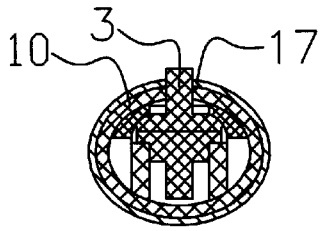
FIG. 3 is a sectional view taken along line B—B of FIG. 2.

As shown in FIG. 3, the tubular housing 10 has a longitudinal slot 17 for the passage of the hand wheel 5 and the hand wheel 5 is partially extended out of the longitudinal slot 17 for finger control.

When in use, it is only necessary to open the cap 1 and then turn the hand wheel 5 to lift the lipstick out of the connecting sleeve 2 for use. In addition, as the lipstick will not rub with the connecting sleeve 2 in moving, the service life of the lipstick will not be reduced. After use, the hand wheel 5 can be simply turned to retract the lipstick into the connecting sleeve and then the cap 1 can be closed for next use.

It will be understood that each of the elements described above, or two or more together may also find a useful, application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lipstick case comprising:

a tubular housing;

a connecting sleeve fitted within said tubular housing and having an upper end extending out of said tubular housing;

a cap engageable with said upper end of said connecting sleeve;

a core movably mounted within said connecting sleeve and having a chamber for receiving a lipstick, said core having a downwardly extending member;

a supporting bracket disposed within said tubular housing and provided with two vertical members;

a hand wheel rotatably arranged between said two vertical members and formed with two gears at two sides thereof; and a toothed rack fixedly mounted on an inner side of said downwardly extending member of said core and meshed with one of said gears of said hand wheel.

2. The lipstick case as claimed in claim 1, further comprising another toothed rack fixedly mounted on said inner side of said downwardly extending member of said core and meshed with said gears of said hand wheel.

* * * * *